United States Patent [19]

Ahlborn et al.

[11] Patent Number: 5,024,166

[45] Date of Patent: Jun. 18, 1991

[54] BOGIE FOR RAIL VEHICLES

[75] Inventors: Günter Ahlborn, Siegen; Herbert Büdenbender, Netphen; Alfred Lohmann, Siegen-Eisern, all of Fed. Rep. of Germany

[73] Assignee: Waggon Union GmbH, Siehe Anlage, Fed. Rep. of Germany

[21] Appl. No.: 389,777

[22] Filed: Aug. 4, 1989

[30] Foreign Application Priority Data

Nov. 26, 1988 [DE] Fed. Rep. of Germany ..... 3839994

[51] Int. Cl.[5] ..... B61F 5/14

[52] U.S. Cl. ..... 105/453; 105/199.1; 105/182.1; 105/206.1

[58] Field of Search ..... 105/157.1, 158.2, 178, 105/182.1, 183, 185, 188, 189, 222, 453, 454, 167, 197.05, 197.1, 199.1, 199.3, 224.05, 204, 206.1, 224.1, 224

[56] References Cited

U.S. PATENT DOCUMENTS

| | | | |
|---|---|---|---|
| 560,779 | 5/1896 | Cliff | 105/188 |
| 2,475,327 | 7/1949 | Keller | 105/188 |
| 3,041,985 | 7/1962 | Brill et al. | 105/453 |
| 4,817,535 | 4/1989 | Terlecky | 105/199.1 |

FOREIGN PATENT DOCUMENTS

| | | | |
|---|---|---|---|
| 0449024 | 8/1927 | Fed. Rep. of Germany | 105/453 |
| 0625764 | 1/1936 | Fed. Rep. of Germany | 105/199 |
| 0669868 | 12/1938 | Fed. Rep. of Germany | 105/453 |
| 0812534 | 5/1937 | France | 105/199.1 |
| 0056280 | 3/1936 | Norway | 105/199.1 |
| 0424853 | 5/1967 | Switzerland | 105/4.1 |
| 0017525 | of 1896 | United Kingdom | 105/199.1 |
| 1212513 | 11/1970 | United Kingdom | 105/453 |

*Primary Examiner*—Matthew C. Graham
*Assistant Examiner*—Mark T. Le
*Attorney, Agent, or Firm*—McGlew & Tuttle

[57] ABSTRACT

A bogie for rail vehicles with a low-seated loading ramp, comprises at least two sets of wheels with a small axle base and a bogie frame comprising lateral cheeks and a traverse extending between every two axles. The sets of wheels are clamped into the bogie frame by axle bearings, and the bogie is connected to the vehicle frame merely by a carrying leaf spring carried by suspension rings. A fixing device cooperates with the suspension rungs to limit the movement of the bogie relative to the rail vehicle. The rocking or swaying properties of the bogie are optimized to improve the running behavior on straight stretches as well as on curves while providing the required transverse play of the bogie. The construction is made more favorably by employing long suspension rings. The power transfer from the loading ramp through the carrying leaf spring to the bogie is improved by carrying leaf springs on spring brackets arranged laterally between the structure gauge and the freight hold of the vehicle and on the outside of the lateral cheeks and above the rails.

7 Claims, 2 Drawing Sheets

BOGIE FOR RAIL VEHICLES

BACKGROUND OF THE INVENTION

Field of the Invention

This invention relates in general to rail structures and in particular to a new and useful bogie for rail vehicles which has a low seated loading ramp.

The invention relates particularly to a bogie for rail vehicles with a deep-seated loading ramp, comprising at least two wheel sets with a small axle base and a bogie frame or car comprising side walls and transoms between two axles. The sets of wheels are fastened in the bogie frame by means of the axle bearings, and the bogie is connected to the car frame merely by means of a load carrying leaf spring and a suspension ring arranged laterally and lengthwise. Catches limit the movement of the bogie relative to the rail vehicle.

Bogies for rail vehicles with a loading ramp located below the buffer level are known. Usually sets of wheels with a small diameter are used, the bogie bolster or the connection of the lateral cheeks of the bogies are cranked downward in the transverse center of the bogie to receive a swivel ring. In this arrangement the large axle base due to the cranking of the bogie bolster or the connection of the lateral cheeks of the bogies is a drawback.

German patent DE-PS 23 02 550 discloses two-axle bogies or four-wheel bogie, in which the bogie frame carries a horn plate or half-axle guard or guide which is vertically open and whose inner shape is that of a rectangle at each of the transverse ends in its longitudinal center. Herein a straight and level horn plate which is fastened to the bogie frame protrudes into the horn plate guide. In the known embodiment of a two-axle or four-wheel bogie, the bogie is guided on the vehicle like a single axle. Longitudinal play and lateral play as well as the horizontal swing of the bogie are limited by the play in the horn plate guide. The small axle base achieved by this means comes as close as possible to the movement pattern of a single axle. The missing swivel ring or live ring allows for a very low headway. Furthermore, the base or bed plate for the carrying leaf spring is located in front of the axle bearings in transverse directions with regard to the bogie to achieve the low headway.

In this embodiment it is disadvantageous that the carrying leaf spring is arranged directly on the lateral cheeks, which because it is limited upward by the freight hold of the vehicle and downward by the structure gauge merely allows for the use of very short suspension rings for the suspension of the carrying leaf spring. The short suspension rings, which represent the only direct connection between the bogie and the superstructure, result in very high righting moments and therefore result in stronger guiding forces during the taking of curves when the bogie rotates or swivels. A further disadvantage of this bogie is that the lateral play will not be adequate for the dynamics of vehicle movement due to the small spring base and taking into account the kinematic load limit gauge profile.

SUMMARY OF THE INVENTION

The invention provides improved rocking properties in a bogie so as to optimize the running behavior on straight stretches as well as on curves while providing the required transverse play of the bogie and to construct it more favorably by employing long suspension rings. The power transfer from the loading ramp through the carrying leaf spring to the bogie is improved.

According to the invention the carrying leaf springs are on spring brackets arranged laterally between the structure gauge or clearance and the freight hold of the vehicle and on the outside of the lateral cheeks and above the rails. Each carrying leaf spring is mounted directly on the spring bracket in a two-axle or four-wheel bogie and in a three-axle or six-wheel bogie it is mounted on the spring brackets by means of a traverse. The outside of each spring bracket is adjusted to the structure gauge and are formed horizontally outward from the lateral cheek, then upward at an angle and it points vertically upward in the area of the spring base. Each carrying leaf spring is advantageously arranged laterally between the structure gauge and the freight hold of the vehicle and above the load level.

Due to this arrangement of the carrying leaf springs of the bogie the length of the suspension ring can be designed optimally. The righting moments occurring during the taking of curves is calculated exactly. For an improvement of the running behavior of the bogie on straights and on bends the bogie is to be provided with a respectively large lateral play, as this can now be compensated for in the upper part of the vehicle by means of the arrangement of the spring brackets between the structure gauge and the freight hold of the vehicle and due to the extremely wide spring base and the increased rocking rigidity of the vehicle.

Furthermore, each spring bracket is provided with a rotational escapement cooperating with the vehicle on its upside and is located between the spring base and the lateral cheek of the bogie frame. This rotational escapement can be arranged advantageously due to the protruding spring brackets and it improves the running stability of the vehicle.

Accordingly, it is an object of the invention to provide a bogie for rail vehicles which travel over rails having a rail gauge and which comprises a frame having transversely spaced apart side walls and a bottom ramp portion between said walls which is low seated. The arrangement includes a plurality of opposed sets of axle bearings journaled in the side walls for a plurality of wheel sets each having an axle journaled in said bearings. Each wheel set includes at least one pair of wheels which are engageable on the rails, a ramp floor defining a freight hold platform overlying said wheels. A traverse is provided extending between and is the supported by said side walls and is located between every two axles. A pair of axially spaced sets of suspension rings are carried by the frame following each end of the wheel sets. These are arranged between the rail gauge and the side walls and they include a fixing device which limits the movement of the bogie and which includes a leaf spring suspended between the axially spaced rings adjacent each side wall and above said wheels.

A further object of the invention is to provide a bogie for rail vehicles which includes a low seated loading ramp.

A further object of the invention is to provide a bogie for rail vehicles which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DETAILED DESCRIPTION OF THE DRAWINGS

Figure 2:
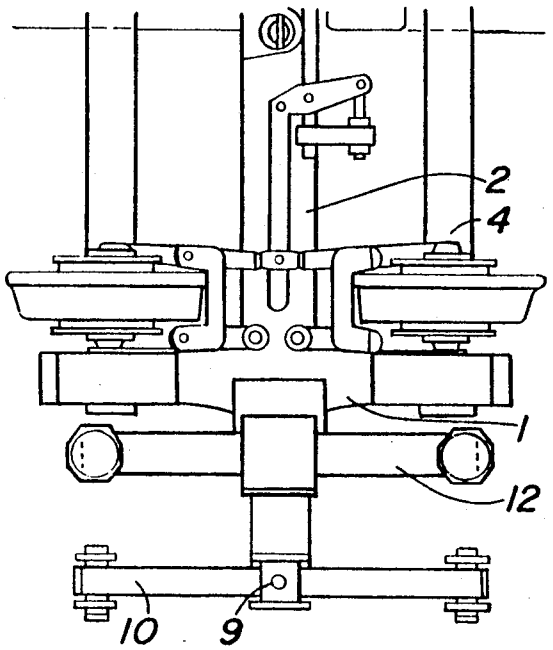
FIG. 2 is a partial top plan view of the bogie according to FIG. 1.
Figure 1:
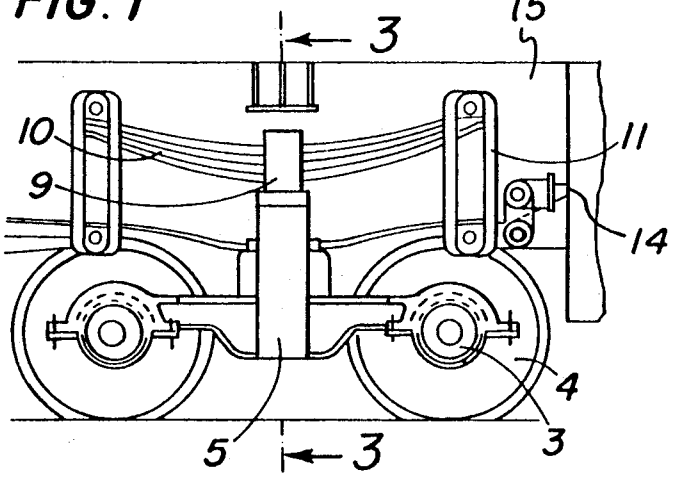
FIG. 1 is a side elevational view of a two-axle bogie constructed according to the invention.
Figure 3:
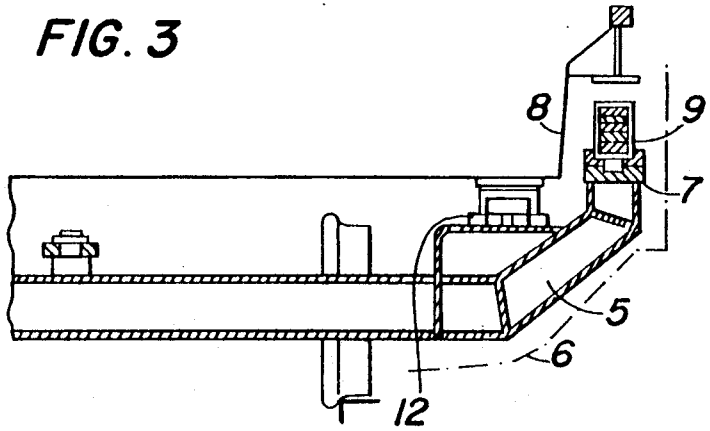
FIG. 3 is a vertical cross section taken along line 3—3 of FIG. 1.

As is shown in FIGS. 1 to 3, the frame of a two-axle bogie according to the invention has an approximately H-shaped horizontal cross section. The lateral cheeks or side walls 1 and the traverse 2 form the bogie frame. The wheel 4 are clamped into the lateral cheeks 1 by means of axle bearings 3. The axle base of each wheel set has been chosen as small as possible. Spring brackets 5 are arranged centrically on the outside of the lateral cheeks 1. The outside of each spring bracket 5 is adjusted to the structure gauge or structural clearance 6 determined by railroad standards (to avoid objects during travel); and formed horizontally outward from the lateral cheek 1, then upward at an angle and it points vertically upward in the area of the spring base 7. The spring base 7 is arranged laterally between the freight hold 8 and the structure gauge 6, and in the embodiment it is positioned above the wheels of the wheel sets 4. A carrying leaf spring 10 with its spring bundle 9 is mounted on the spring base 7 parallel with regard to the lengthwise direction of the bogie, the carrying leaf spring 10 is connected to the vehicle by means of long suspension rings or chain links 11. A rotational escapement 12 is arranged on top of the spring bracket 5 between the lateral cheek 1 and the spring base 7 and cooperates with the body of the vehicle to limit rotational movement of the vehicle body 15.

Figure 5:
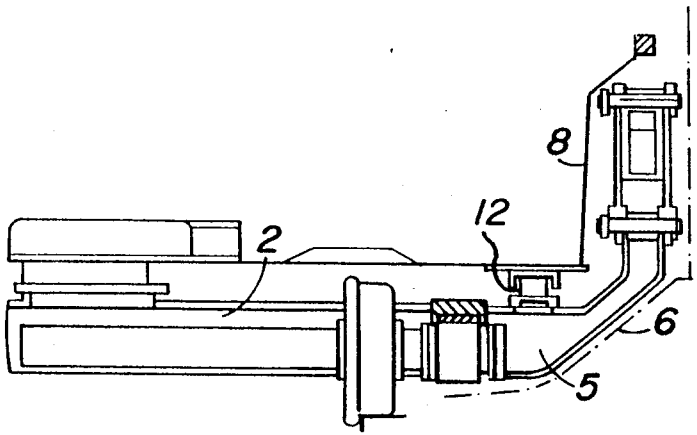
FIG. 5 is a vertical cross section through line 5—5 of FIG. 4.
Figure 4:
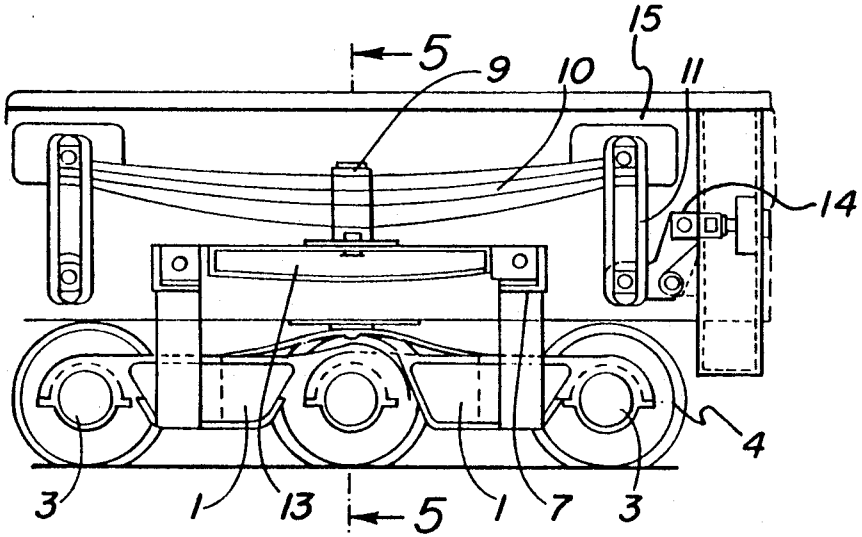
FIG. 4 is a side elevational view of a three-axle bogie constructed according to the invention.

In FIG. 4 and 5 the invention is explained by means of a three-axle bogie. In this three-axle bogie the bogie frame comprises the lateral cheeks 1, and a traverse 2 each arranged between two wheel sets 4 and connecting the lateral cheeks 1, which are split in the area of the middle wheel set 4 and connected to one another articulately and vertically movable. Here, too, wheel sets are clamped in the lateral cheeks 1 by means of the axle bearings 3. A spring bracket 5 each is arranged between the middle set of wheels 4 and each outer set of wheels 4 on the outside of the lateral cheek 1. The arrangement of this spring bracket 5 is such that the spring bracket is positioned at a distance of 1/3 to 2/3 the distance from the outer set of wheels 4. The spring bracket 5 is adjusted to the structure gage or structural clearance 6 and runs horizontally outward, then upward at an angle and then vertically upward in the region of the spring base 7. In the three-axle bogie a traverse 13 is provided connecting the two spring brackets 5 and is arranged articulately on the spring base of the spring brackets 5. The traverse 13 carries the spring bundle 9 of the carrying leaf spring 10 centrally. The carrying leaf spring 10 is mounted to the vehicle body 15 via long suspension rings or chain links 11 and connection bracket 14. The connection bracket 14 being rigidly connected to the freight body In the three-axle bogie the carrying leaf spring 10 is also arranged between the freight hold 8 of the vehicle and the lateral limitation line of the structure gauge 6, and in the embodiment shown also above the wheels of the wheel sets 4.

While specific embodiments of the invention have been shown and described in detail to illustrate the application of the principles of the invention, it will be understood that the invention may be embodied otherwise without departing from such principles.

What is claimed is:

1. A bogie arrangement for rail vehicle with a low-seated loading ramp of a vehicle body and having a rail vehicle structure gauge, comprising:

a bogie frame having opposed lateral cheeks and a traverse member connecting said opposed lateral cheeks; a plurality of wheel sets, each wheel set including an axle defining a small axle base, said wheel sets being mounted to said bogie frame lateral cheeks via axis journals; a spring bracket connected to said lateral cheeks and extending outwardly from said lateral cheeks of said bogie frame toward an outer limit of said structure gauge; suspension rings connected to said vehicle body; supporting leaf springs connected to said spring bracket and having ends extending outwardly from said spring bracket; fixing elements associated with each of said suspension rings, said leaf spring ends each being connected to an associated suspension ring by one of said fixing elements such that said supporting leaf springs are arranged outside of said side cheeks extending laterally between the limit of said structure gauge and a cargo space of said vehicle body and above said wheel sets.

2. An undercarriage according to claim 1, wherein each said supporting leaf spring is mounted directly on said bracket.

3. An undercarriage according to claim 1 wherein each spring bracket has an outer edge positioned inside the limit of said structural gauge, said spring bracket having a first portion extending horizontally outward from said lateral cheek and having a second portion extending obliquely in an upward and outward direction and having a third portion extending vertically in an upward direction.

4. An undercarriage according to claim 1 wherein each said supporting leaf spring is arranged between the limit of said structural gauge and the cargo space of the vehicle and above a vehicle loading defined by said loading rim.

5. An undercarriage according to claim 1, wherein said spring bracket is connected to a rotation inhibition mechanism inhibiting the rotational movement of the vehicle body.

6. A bogie arrangement for rail vehicle with a low-seated loading ramp of a vehicle body and having a rail vehicle structure gauge, comprising:

a bogie frame having opposed lateral cheeks and a traverse member connecting said opposed lateral cheeks; a plurality of wheel sets, each wheel set including an axle defining a small axle base, said wheel sets being mounted to said bogie frame lateral cheeks via axle journals; spring brackets connected to said lateral cheeks, one of said spring brackets extending outwardly from each of said lateral cheeks of said bogie frame toward an outer limit of said structure gauge; suspension rings connected to said vehicle body, said vehicle body including a platform overlying said wheel sets, and having a portion extending between said spring brackets; supporting leaf springs connected to said spring bracket and having ends extending outwardly from said spring bracket; fixing elements associated with each of said suspension rings, said leaf spring ends each being connected to an associated suspension ring by one of said fixing elements such that said supporting leaf springs are arranged outside of said side cheeks extending laterally between the limit of said structure gauge and a cargo space of said vehicle body and above said wheel sets, said bogie frame being fixedly connected to said vehicle body only via said supporting leaf springs.

7. A bogie arrangement for rail vehicle with a low-seated loading ramp of a vehicle body and having a rail vehicle structure gauge, comprising:

a bogie frame having opposed lateral cheeks and traverse member connecting said opposed lateral cheeks; a plurality of wheel sets, each wheel set including an axle defining a small axle base, said wheel sets being mounted to said bogie frame lateral cheeks via axle journals; spring brackets, one of said spring brackets connected to said lateral cheeks extending outwardly from said lateral cheeks of said bogie frame toward an outer limit of said structure gauge and including a first portion extending horizontally outward from said one of said side cheeks and having a second portion extending obliquely in an upward and outward direction and having a third portion extending vertically in an upward direction; suspension rings connected to said vehicle body; supported leaf springs connected to said spring bracket and having ends extending outwardly from said spring bracket; fixing elements associated with each of said suspension rings, said leaf spring ends each being connected to an associated suspension ring by one of said fixing elements such that said supporting leaf springs are arranged outside of said side cheeks extending laterally between the limit of said structure gauge and a cargo space of said vehicle body and extending above said wheel sets.

* * * * *